US007000257B2

(12) United States Patent
Bevier

(10) Patent No.: US 7,000,257 B2
(45) Date of Patent: Feb. 21, 2006

(54) GLOVE WITH STITCHLESS SEAMS

(75) Inventor: Joseph J. Bevier, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 10/883,004

(22) Filed: Jul. 1, 2004

(65) Prior Publication Data

US 2006/0010562 A1 Jan. 19, 2006

(51) Int. Cl.
*A41D 19/00* (2006.01)

(52) U.S. Cl. ..... 2/159

(58) Field of Classification Search ..... 2/158, 2/159, 160, 161, 162, 163, 164, 165, 166, 2/167, 168, 169, 170
See application file for complete search history.

(56) References Cited

U.S. PATENT DOCUMENTS

| | | | | |
|---|---|---|---|---|
| 3,560,601 | A | 2/1971 | Johnson et al. | |
| 5,105,478 | A | 4/1992 | Pyc | |
| 5,598,582 | A * | 2/1997 | Andrews et al. | 2/16 |
| 5,620,771 | A | 4/1997 | Middleton | |
| 5,656,352 | A | 8/1997 | Middleton | |
| 5,733,626 | A | 3/1998 | Middleton | |
| 5,935,878 | A | 8/1999 | Glasser | |
| 6,339,845 | B1 | 1/2002 | Burns et al. | |
| 6,543,058 | B1 * | 4/2003 | Litke | 2/161.2 |
| 6,618,860 | B1 * | 9/2003 | Sullivan et al. | 2/159 |
| 6,625,815 | B1 * | 9/2003 | Litke | 2/161.2 |
| 6,704,939 | B1 * | 3/2004 | Faulconer | 2/161.1 |
| 2003/0188373 | A1 * | 10/2003 | Garneau | 2/161.1 |

FOREIGN PATENT DOCUMENTS

| | | |
|---|---|---|
| GB | 2316353 | 2/1996 |
| GB | 2312643 | 11/1997 |
| JP | 4308277 | 10/1992 |

OTHER PUBLICATIONS

Website pages from Bemis Associates, Inc. (copyrighted 1998-2002) (5 pages).
"General Guidelines for Using Heat Seal Film Adhesives in Embroidery Applications" from Bemis Associates (Revised Feb. 2000) (8 paegs total).

* cited by examiner

*Primary Examiner*—John J. Calvert
*Assistant Examiner*—Brian Kauffman
(74) *Attorney, Agent, or Firm*—Banner & Witcoff, Ltd.

(57) ABSTRACT

A structure of a glove is disclosed that includes a first material element and a second material element. The material elements are separate from each other and positioned adjacent each other, and the material elements are joined with a stitchless configuration, that may be a stitchless seam. An adhesive element may be secured to each of the first material element and the second material element to form the stitchless configuration. The adhesive element may be a polymer, and more particularly, may be a thermoplastic polymer.

18 Claims, 9 Drawing Sheets

GLOVE WITH STITCHLESS SEAMS

BACKGROUND OF THE INVENTION

1. Field of the Invention

The present invention relates to articles of apparel, including gloves. The invention concerns, more particularly, a glove with material elements that are joined in a stitchless manner. The invention has application to a variety of glove styles that are utilized during athletic activities.

2. Description of Background Art

A conventional glove is generally formed from multiple material elements that are joined together to form a structure for covering at least a portion of a hand. The material elements may include, for example, various textiles, leather, insulative materials, and foams. Textiles that stretch or otherwise conform to contours of the hand may be utilized to form a glove that suits a wide range of hand shapes and sizes. Similarly, textiles that permit air flow between opposite sides may be utilized to impart cooling or facilitate removal of perspiration. Whereas leather is generally incorporated into a glove to impart a relatively high degree of durability, insulative materials may protect the hand from temperature extremes, whether hot or cold. In addition, foams may be incorporated into a glove in order to attenuate forces and absorb energy (i.e., impart cushioning). Accordingly, the design of a glove often involves selecting a combination of material elements that are appropriate for the activities and environmental conditions in which the glove is intended to be used.

The material elements of a conventional glove are commonly joined through a stitching process, for example. Accordingly, a thread repetitively passes through two or more material elements to join the material elements together and form stitched seams. An adverse effect of this manner of joining material elements is that the stitched seams form a discontinuity in the conventional glove that the individual may sense. That is, the individual may detect or otherwise feel the presence of the stitched seams. When the glove is utilized, therefore, the stitched seams may form areas of discomfort as the stitched seams contact the skin of the individual. In addition, the stitched seams may inhibit the tactile properties of the conventional glove. For example, the stitched seams may obscure or decrease the degree to which the individual may sense objects that are in contact with the glove.

SUMMARY OF THE INVENTION

One aspect of the present invention relates to a glove for covering at least a portion of a hand. The glove includes a first material element and a second material element. The material elements are separate from each other and positioned adjacent each other, and the material elements are joined with a stitchless configuration. An adhesive element may be secured to each of the first material element and the second material element to form the stitchless configuration. The adhesive element may be a polymer, and more particularly, may be a thermoplastic polymer.

The material elements may be arranged such that a first edge of the first material element abuts a second edge of the second material element. In this configuration, the adhesive element is bonded to the first material element adjacent to the first edge, and the thermoplastic polymer adhesive element is bonded to the second material element adjacent to the second edge. Similarly, the adhesive element may extend over the abutting interface of the first edge and the second edge. Furthermore, a third material element may be secured to the first material element and the second material element with an adhesive element to form the stitchless configuration.

The material elements may also be arranged such that the first material element and the second material element overlap each other. In this configuration, the adhesive element is positioned between the first material element and the second material element, and the thermoplastic polymer adhesive element is bonded to each of the first material element and the second material element to form the stitchless configuration.

Another aspect of the invention relates to method of manufacturing a glove for covering at least a portion of a hand. The method includes a step of positioning the first material element adjacent the second material element. In addition, the method includes forming a stitchless seam between the first material element and the second material element by bonding the first material element and the second material element together with at least one thermoplastic polymer adhesive element.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose an article of apparel, particularly a glove 10, with various stitchless seams. Glove 10 is depicted as having a configuration that is suitable for athletic activities, whether practice sessions or competitions. Although glove 10 is depicted in the figures and discussed in the following material as having a configuration that is suitable for the game of football, for example, the concepts associated with glove 10 may be applied to a wide range of glove styles, whether for athletic or non-athletic activities.

In a conventional glove, a thread repetitively passes through two or more material elements to join the material elements together and form stitched seams. In contrast with the conventional glove, glove 10 includes various stitchless seams that do not include a thread. In comparison with the conventional glove, the stitchless seams of glove 10 may enhance comfort and tactile properties. For purposes of the present document, the term "stitchless seams" is defined as an area where material elements are joined without a thread or other yarn-like material.

Figure 1:
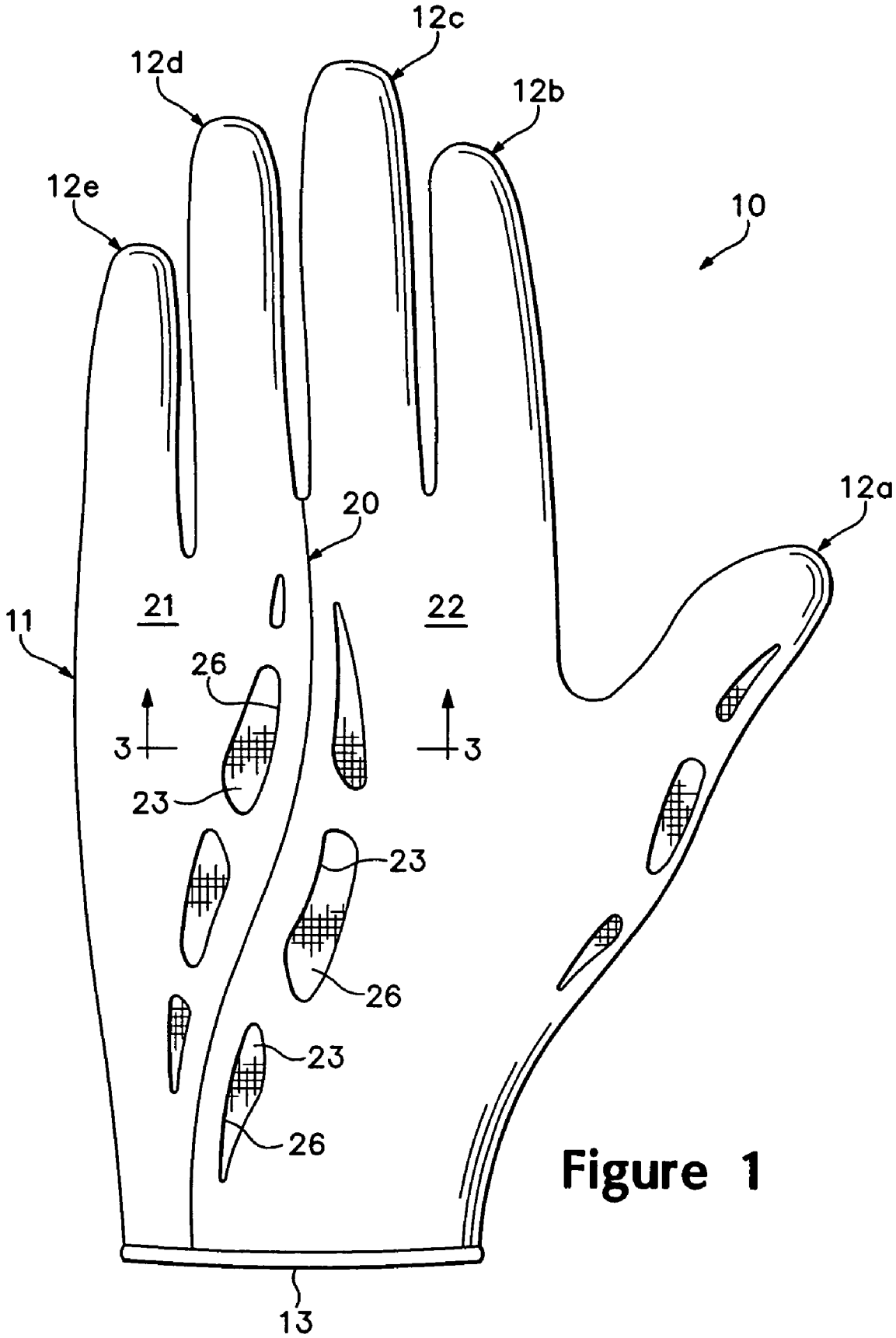
FIG. 1 is a top plan view of a glove in accordance with the present invention.

Glove 10 generally includes a palmar region 11, five digital regions 12*a*–12*e*, and a wrist opening 13, as depicted in FIG. 1. For purposes of reference, the locations of palmar region 11 and digital regions 12*a*–12*e* will be discussed relative to the positions of the various bones of the hand. Palmar region 11 is generally located to corresponds with and cover the metacarpal bones, and may extend rearward to cover the wrist bones or other areas of the lower arm. Digital regions 12*a*–12*e* extend forward from palmar region 11 to correspond with and cover each of the proximal, middle, and distal phalanges. More particularly, digital region 12*a* corresponds with the first digit (i.e., the thumb), digital region 12*b* corresponds with the second digit (i.e., the index finger), digital region 12*c* corresponds with the third digit (i.e., the middle finger), digital region 12*d* corresponds with the fourth digit (i.e., the ring finger), and digital region 12*e* corresponds with the fifth digit (i.e., the pinky finger). Although the interface between palmar region 11 and digital regions 12*a*–12*e* may vary significantly within the scope of the present invention, the interface is depicted as being approximately located at the joints between the metacarpals and proximal phalanges. Wrist opening 13 provides the hand with access to the interior of glove 10.

The general configuration of glove 10 discussed above effectively covers the hand and may also cover portions of the lower arm. In other embodiments of the invention, however, digital regions 12*a*–12*e* may be truncated such that the one or more of the first through fifth digits extend out of glove 10 and are not covered by glove 10. In yet another embodiment of the invention, glove 10 may include a single digital region that corresponds with and covers each of the second through fifth digits. That is, glove 10 may have the configuration of a mitten. Accordingly, the various concepts discussed in the following materials may be incorporated into a variety of glove configurations, including the specific configuration of glove 10 depicted in the figures.

Figure 2:
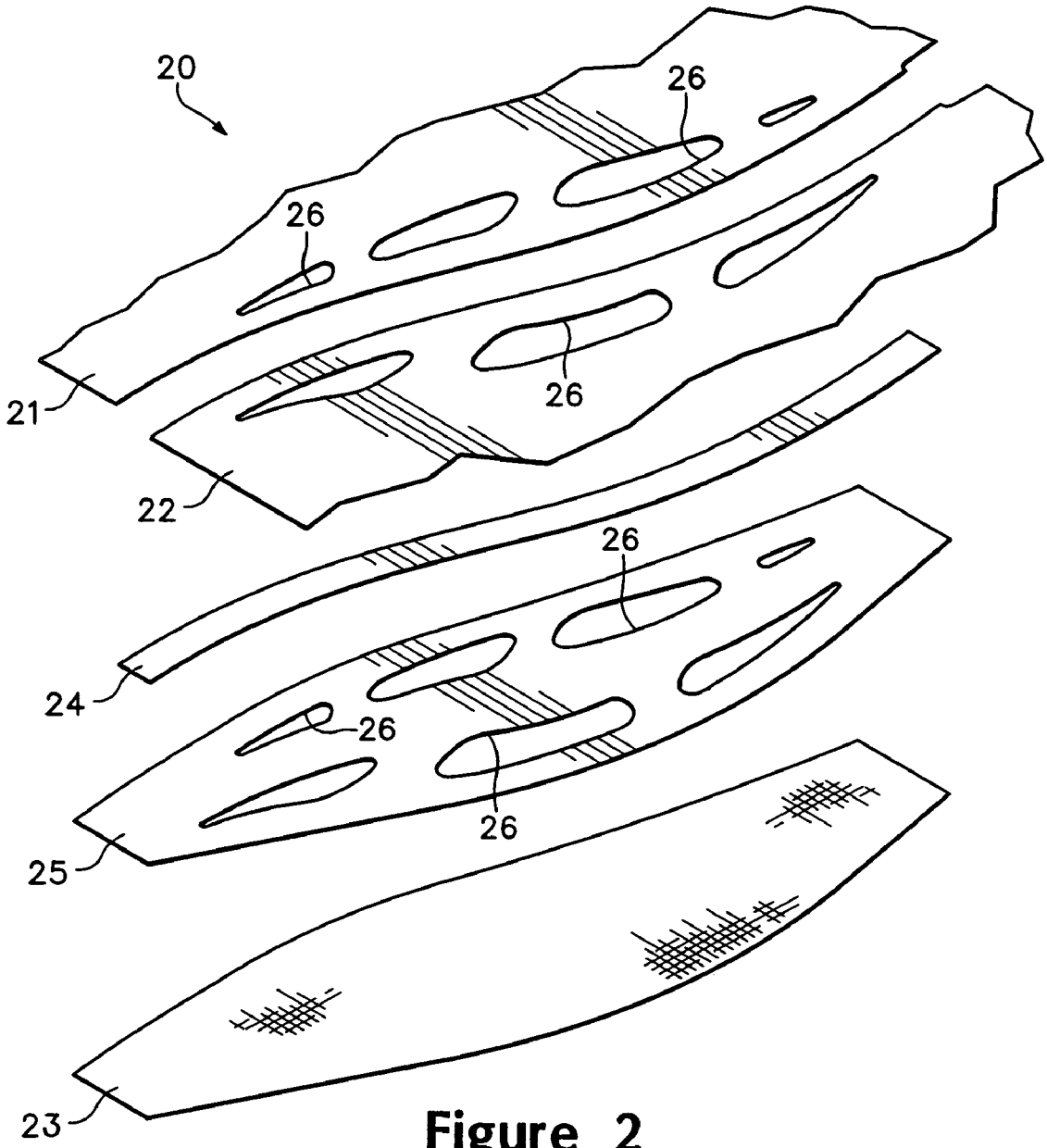
FIG. 2 is an exploded perspective view of a portion of the glove.
Figure 3:
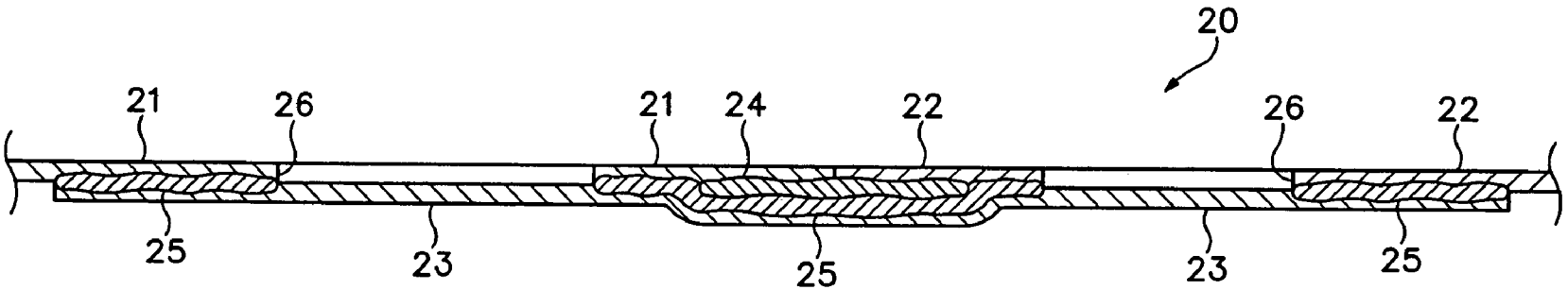
FIG. 3 is a cross-sectional view of the glove, as defined along section line 3—3 in FIG.

A seam 20 is depicted in FIG. 1 as extending through palmar region 11. More particularly, seam 20 effectively bisects palmar region 11 and extends from wrist opening 13 to the area of palmar region 11 located between digital regions 12*c* and 12*d*. Referring to FIGS. 2 and 3, seam 20 is formed from three material elements: a first material element 21, a second material element 22, and a third material element 23. Material elements 21–23 may be textile materials, for example, as discussed below. Seam 20 also includes a pair of adhesive elements: a first adhesive element 24, and a second adhesive element 25. Adhesive elements 24 and 25 may be thermoplastic polymer sheets or strips, also as discussed below.

Edges of first material element 21 and second material element 22 abut on the exterior of palmar region 11 to effectively form the visible portion of seam 20. Accordingly, material elements 21 and 22 form a portion of the exterior of glove 10. Material elements 21 and 22 cooperatively define seven apertures 26 that extend along seam 20, and third material element 23 is exposed through the various apertures 26. Adhesive elements 24 and 25 are positioned between third material element 23 and the combination of material elements 21 and 22. More particularly, adhesive element 24 contacts the abutting interface of material elements 21 and 22, and adhesive element 24 effectively joins material elements 21 and 22. Whereas adhesive element 24 is relatively narrow (e.g., in a range of 3 to 10 millimeters), adhesive element 25 exhibits greater dimensions and extends around the various apertures 26. Accordingly, adhesive element 24 is positioned between adhesive element 25 and the combination of material elements 21 and 22. Seam 20, therefore, exhibits a layered structure wherein the combination of material elements 21 and 22 form a first layer, adhesive element 24 forms a second layer, adhesive element 25 forms a third layer, and third material element 23 forms a fourth layer, as depicted in each of FIGS. 2 and 3.

Material elements 21–23 are formed from flexible and generally two-dimensional materials. As utilized with respect to the present invention, the term "two-dimensional materials" is intended to encompass generally flat materials exhibiting a length and a width that are substantially greater than a thickness. Accordingly, suitable materials for material elements 21–23 include various textiles and polymer sheets, for example. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven fabric. The textiles may incorporate fibers that are arranged to impart one-directional stretch or multi-directional stretch. The polymer sheets may be extruded, rolled, or otherwise formed from a polymer material to exhibit a generally flat aspect. In addition to textiles and polymer sheets, other two-dimensional materials may be incorporated into material elements 21–23.

Material elements 21–23 may be formed from a variety of materials, including materials such as rayon, nylon, polyester, acrylic, leather, and synthetic suede, for example. In order to provide the stretch and recovery properties to material elements 21–23, elastane fiber may be utilized. Elastane fibers are available from E.I. duPont de Nemours Company under the LYCRA trademark. Such fibers may have the configuration of covered LYCRA, wherein the fiber includes a LYCRA core that is surrounded by a nylon sheath. Other fibers or filaments exhibiting elastic properties may also be utilized. A plurality of other materials, whether elastic or inelastic, are also suitable for material elements 21–23. The characteristics material elements 21–23 depend primarily upon the materials of the yarns that form material elements 21–23. Cotton, for example, provides a soft hand, natural aesthetics, and biodegradability. Elastane fibers, as discussed above, provide substantial stretch and recoverability. Rayon provides high luster and moisture absorption. Wool also provides high moisture absorption, in addition to insulating properties. Polytetrafluoroethylene coatings may provide a low friction contact between the textile and the skin. Nylon is a durable and abrasion-resistant material with high strength. Finally, polyester is a hydrophobic material that also provides relatively high durability.

Each of material elements 21–23 may be formed from the same materials. As an alternative, one or more of material elements 21–23 may be formed from different materials. For example, material elements 21 and 22 may be formed from stretchable textiles having different colors, whereas third material element 23 may be formed from a mesh material that promotes breathability. In other embodiments, one or both of material elements 21 and 22 may also be formed from a mesh material.

Adhesive elements 24 and 25 may be a thermoplastic polymer that forms bonds with material elements 21–23 through the application of sufficient heat and pressure, thereby material elements 21–23. Alternately, adhesive elements 24 and 25 may be a material that forms the bonds through radio frequency or ultrasonic bonding processes, for example. In some embodiments, and as depicted in the figures, adhesive elements 24 and 25 are two-dimensional materials. With regard to the thermoplastic polymer, the amount of heat and pressure applied to form the bonds depends upon the specific material forming adhesive elements 24 and 25, which may be polyurethane, polyamide, polyester, polyolefin, or vinyl. Suitable thermoplastic polymers formed from these materials may be supplied by Bemis Associates, Inc. of Shirley, Mass., United States. In general, the heat and pressure induces adhesive elements 24 and 25 to soften or melt so as to infiltrate the structure of material elements 21–23. Upon subsequent cooling, adhesive elements 24 and 25 becomes securely bonded to each of material elements 21–23, thereby forming seam 20 to have a durable structure without the necessity of stitching.

Glove 10 has advantages over conventional gloves, wherein material elements are commonly joined through a stitching process, for example. As discussed above in the Background of the Invention, an adverse effect of joining material elements with stitching is that the stitched seams form a discontinuity in the conventional glove that the individual may sense. That is, the individual may detect or otherwise feel the presence of the stitched seams. When the glove is utilized, therefore, the stitched seams may form areas of discomfort as the stitched seams contact the skin of the individual. In addition, the stitched seams may inhibit the tactile properties of the conventional glove. For example, the stitched seams may obscure or decrease the degree to which the individual may sense objects that are in contact with the glove. In glove 10, however, seam 20 is a stitchless seam. Accordingly, material elements 21–23 are joined without a thread or other yarn-like material. This configuration may enhance the comfort and tactile properties of glove 10.

Figure 4:
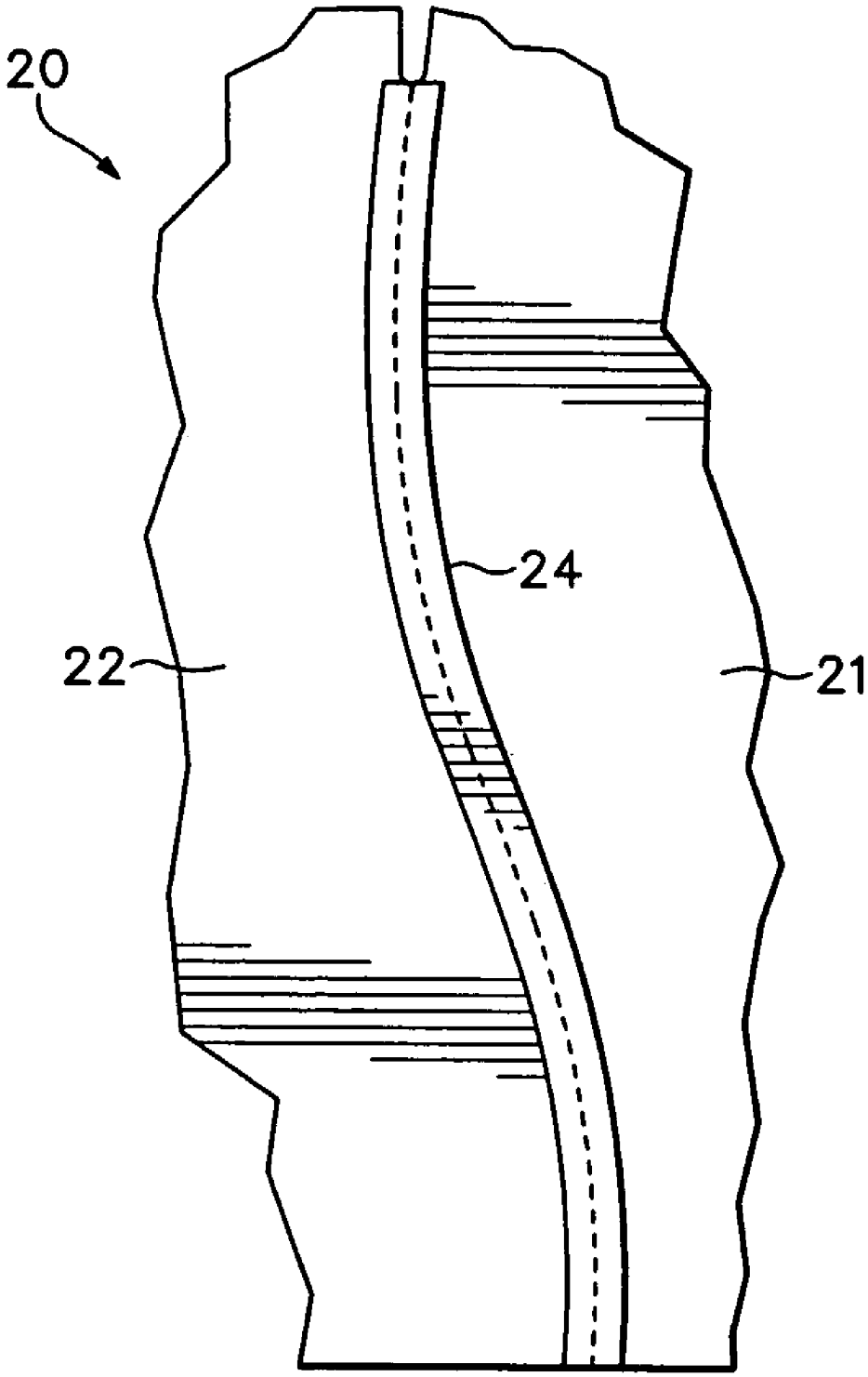
FIG. 4 depicts a first step in a manufacturing process of the glove.

The manner in which seam 20 is formed will now be briefly discussed. A first step in the manufacturing process for seam 20 includes joining material elements 21 and 22 with adhesive element 24, as depicted in FIG. 4. In general, the edges of material elements 21 and 22 are placed in an abutting relationship, and adhesive element 24 is positioned to extend over the abutting interface of material elements 21 and 22. Heat and pressure, for example, is then applied to adhesive element 24 and the abutting interface of material elements 21 and 22, thereby securing first material element 21 to second material element 22. As noted above, adhesive element 24 is relatively narrow and may have a width in a range of 3 to 10 millimeters. The width of adhesive element 24 may vary significantly, however, within the scope of the present invention.

Adhesive element 24 softens or melts so as to infiltrate the structure of material elements 21 and 22 when heat and pressure are applied. Upon subsequent cooling, adhesive element 24 becomes securely bonded to each of material elements 21 and 22. In addition to securing material elements 21 and 22 together, adhesive element 24 also prevents unraveling or fraying of material elements 21 and 22. When adhesive element 24 infiltrates the structure of material elements 21 and 22, the polymer material extends around the various filaments and fibers forming the yarns of material elements 21 and 22. When cooled, adhesive element 24 permanently positions the yarns at the edges of material elements 21 and 22 in their relative positions, thereby preventing unraveling or fraying of material elements 21 and 22.

Figure 5:
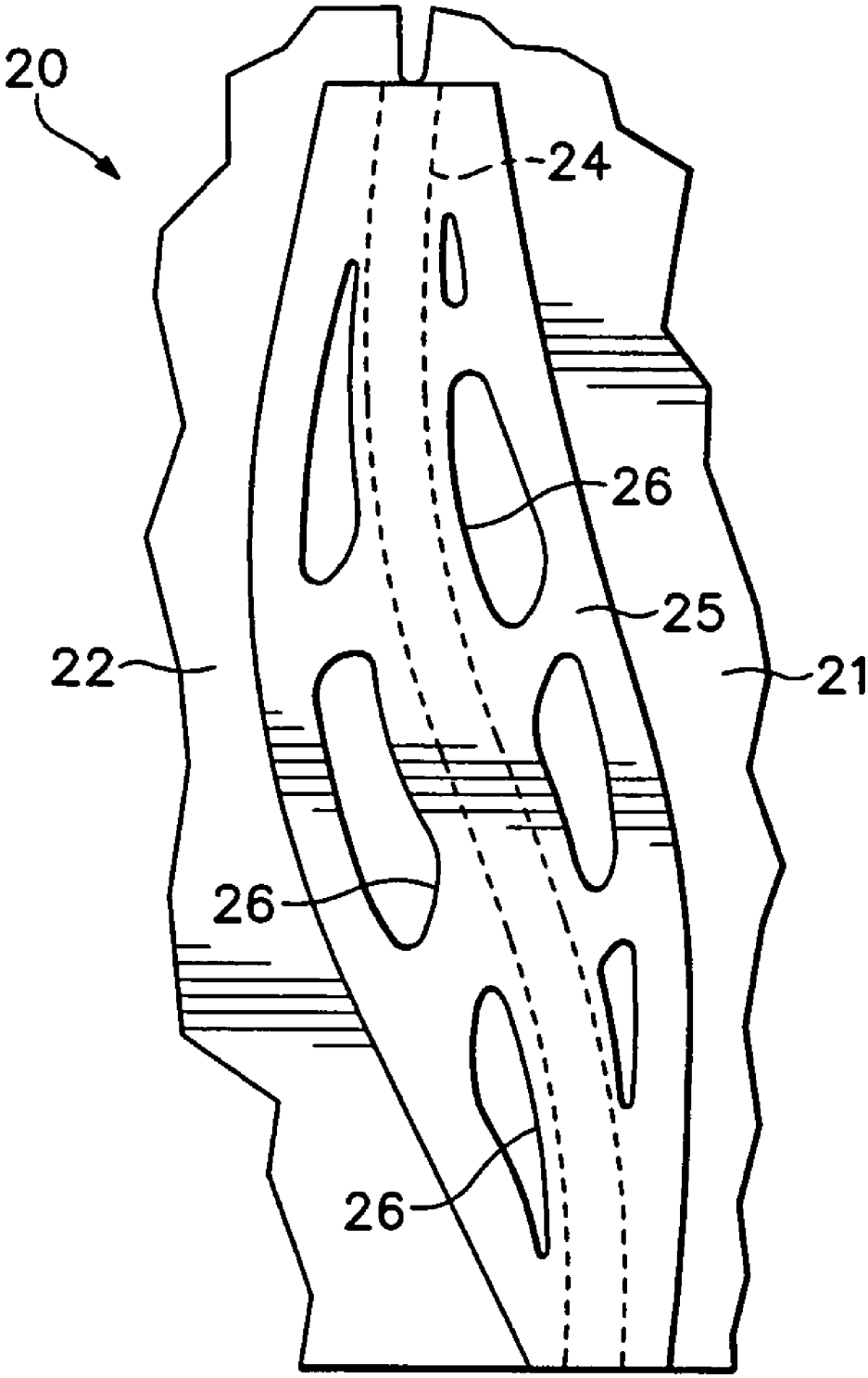
FIG. 5 depicts a second step in the manufacturing process of the first glove.

A second step in the manufacturing process for seam 20 includes bonding adhesive element 25 to material elements 21 and 22, and also forming apertures 26, as depicted in FIG. 5. In general, adhesive element 25 is positioned to extend over the abutting interface of material elements 21 and 22 and also over adhesive element 24. Heat and pressure, for example, is then applied to adhesive element 25, thereby securing adhesive element 25 to material elements 21 and 22. A die cutting or laser cutting operation, for example, is then utilized to define apertures 26. As with the edges of material elements 21 and 22, adhesive element 25 infiltrates the structure of material elements 21 and 22, and the polymer material extends around the various filaments and fibers forming the yarns of material elements 21 and 22. Upon the formation of apertures 26, adhesive element 25 effectively prevents fraying and unraveling of the edges of material elements 21 and 22 that border apertures 26.

Figure 6:
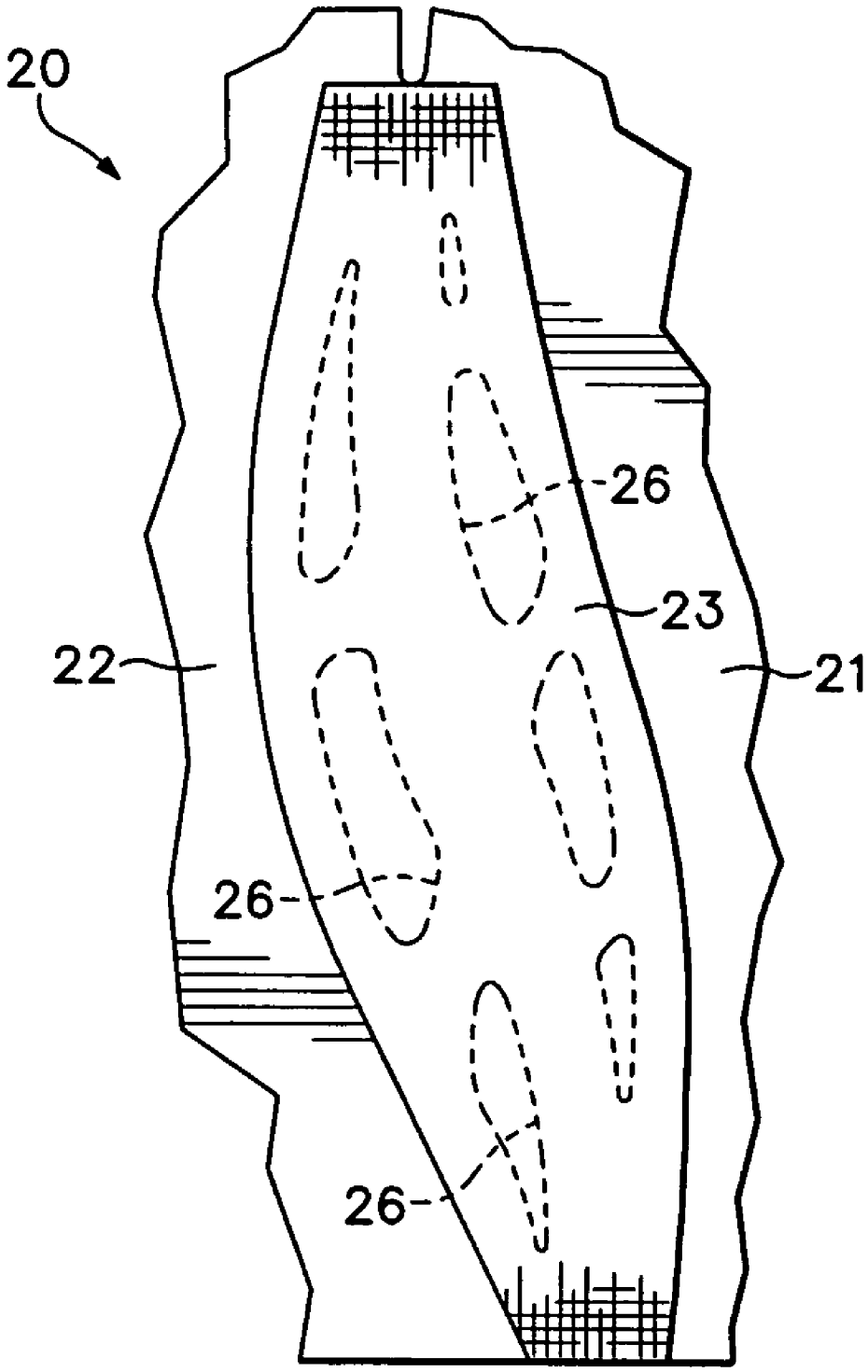
FIG. 6 depicts a third step in the manufacturing process of the glove.

A third step in the manufacturing process for seam 20 includes bonding third textile element 23 to adhesive element 25, as depicted in FIG. 6. Third textile element 23 and adhesive element 25 exhibit substantially similar shapes. In general, third textile element 23 is positioned adjacent to adhesive element 25, and heat and pressure are applied to bond third textile element 23 to adhesive element 25. In addition to material elements 21 and 22, therefore, second adhesive element 25 also infiltrates third textile element 23 and prevents fraying and unraveling of the edges of third material element 23. The position of third textile element 23 extends over apertures 26. Accordingly, third textile element 23 is exposed though apertures 26, as depicted in FIG. 1.

The manufacturing process discussed above provides one example of the manner in which seam 20 may be formed. As an alternative to the process discussed above, only one adhesive element may be utilized in some embodiments of the invention. For example, first adhesive element 24 may be omitted such that second adhesive element serves the functions of both adhesive elements 24 and 25. That is, second adhesive element 25 may be utilized to join material elements 21 and 22 together, prevent fraying of the edges of material elements 21 and 22 and the edges of apertures 26, and join third material element 23 to material elements 21 and 22. In some embodiments, apertures 26 may be omitted, or third textile element 23 may be omitted. Accordingly, the invention encompasses configurations wherein only two material elements are joined to form a stitchless seam.

Seam 20 is depicted and discussed as extending along a portion of glove 10 that corresponds with a back surface of the hand. A seam having the general configuration of seam 20 may be positioned in any area of glove 10. Referring to FIG. 1, a similar construction is depicted as being positioned in digital region 12*a*, but may also be positioned in any of digital regions 12*b*–12*e*.

Figure 7:
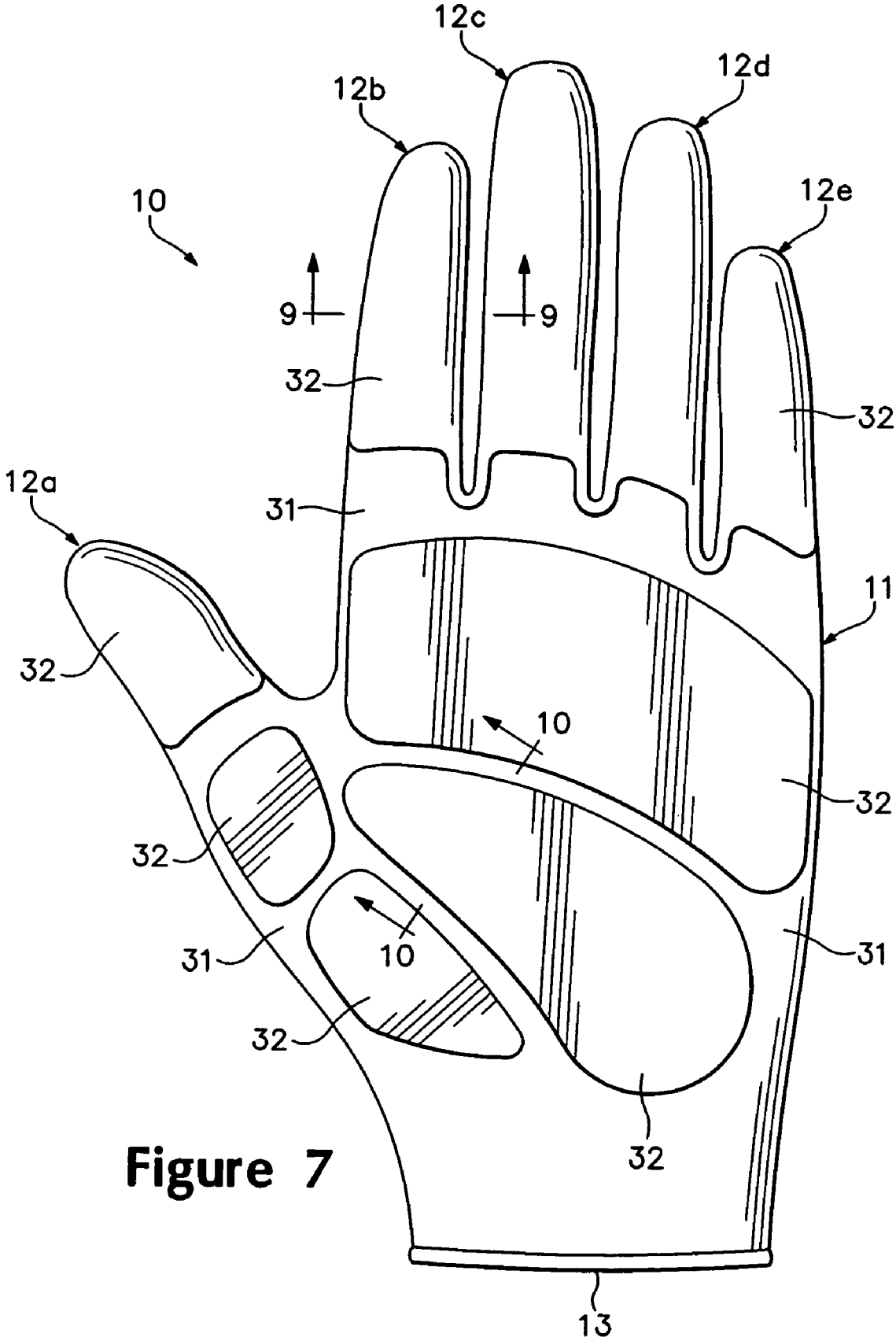
FIG. 7 is a bottom plan view of the glove.

The surface of glove 10 that is depicted in FIG. 1 generally corresponds with a back surface of the hand. An opposite surface of glove 10 is depicted in FIG. 7. A material element 31 forms a base of the opposite surface of glove 10, and material element 31 extends from palmar region 11 to each of digital regions 12*a*–12*d*. A plurality of material elements 32 are joined to material element 31 with a plurality of adhesive elements 33. More particularly, adhesive elements 33 extend between material element 31 and the various material elements 32 in order to join material elements 32 to material element 31 in a seamless manner. That is, a stitchless seam is formed between material element 31 and the various material elements 32. Accordingly, material elements 32 are joined to material element 31 without a thread or other yarn-like material.

Figure 8:
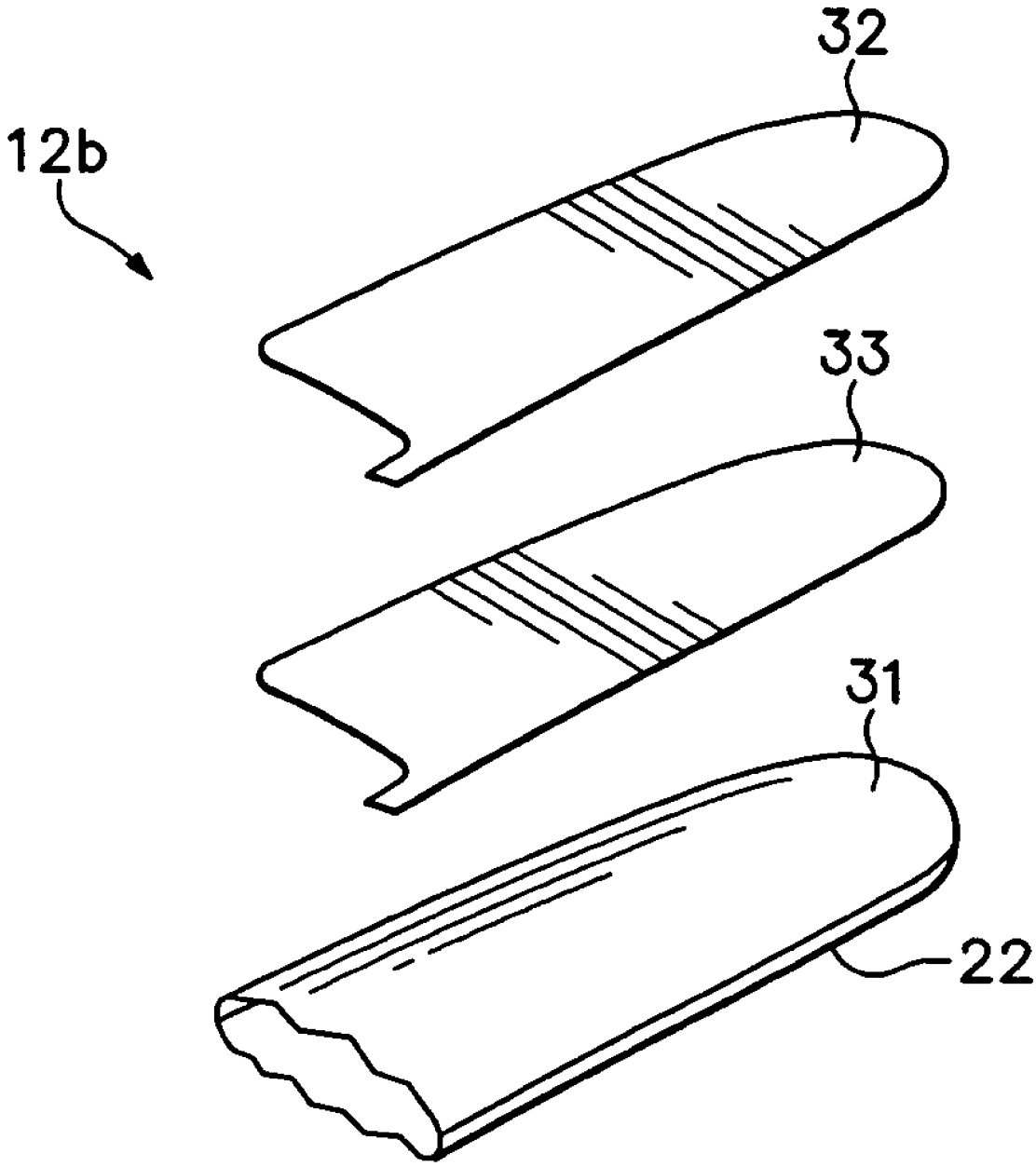
FIG. 8 is an exploded perspective view of a portion of the glove.
Figure 9:
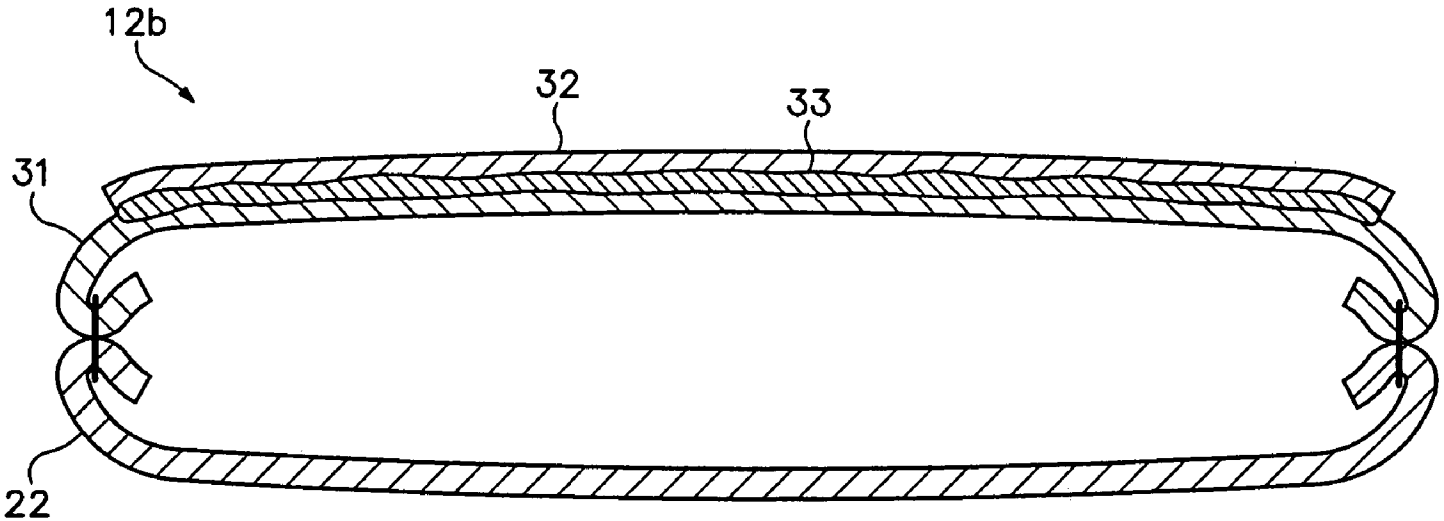
FIG. 9 is a cross-sectional view of the glove, as defined along section line 9—9 in FIG. 7.
Figure 10:
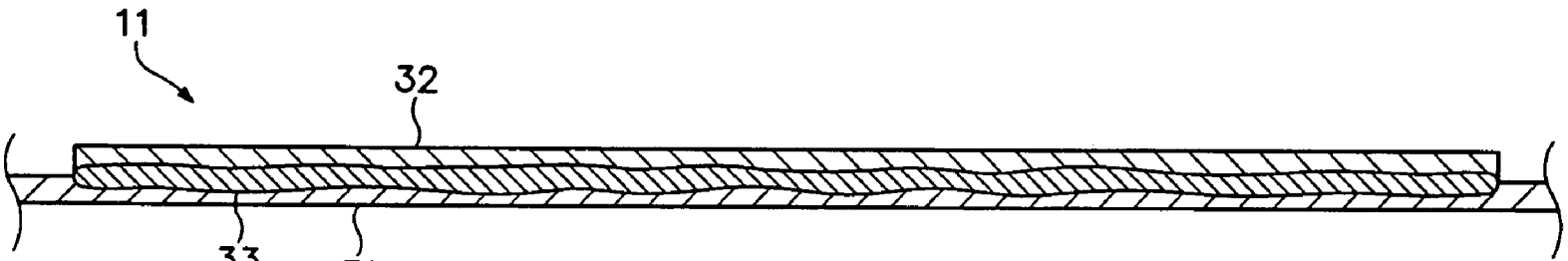
FIG. 10 is another cross-sectional view of the glove, as defined along section line 10—10 in FIG. 7.

Referring to FIG. 8, digital region 12*b* is depicted in an exploded view. Edges of material element 31 are secured to second material element 22 in order to define a void for receiving the second digit. Adhesive element 33 is positioned between material element 31 and material element 32 in order to join the elements together, as depicted in FIG. 9. A similar configuration applies to other materiel elements 32, as depicted in FIG. 10. Material element 31 and material elements 32 may be formed from any of the various materials discussed above relative to material elements 21–23. As an alternative, material elements 32 may be formed from a leather or synthetic suede having a silicone or other relatively high-friction coating. In athletic activities that require contact with game balls, such as football, the high-friction coating promotes catching, grasping, and carrying of the game ball. Adhesive element 33 may also be formed from any of the materials discussed above with respect to adhesive elements 24 and 25. Accordingly, heat and pressure, for example, may be utilized to join material elements 32 with material element 31 in a stitchless manner.

When catching a game ball, for example, the tactile properties of a glove affect an individual's ability to properly sense the position of the ball. The thread in the stitched seams of digital regions 12*a*–12*e* and palmar region 11 may inhibit the ability of the individual to properly sense the position of the ball. That is, stitched seams in glove 10 may inhibit the ability of the individual to catch the game ball. The various material elements 32, however, are joined without stitched seams. In other words, stitchless seams are utilized in glove 10 to join material elements 32 to material element 31. In addition to enhancing the comfort of glove 10, the stitchless seams promote the ability of the individual to catch, grasp, and carry the game ball.

Based upon the above discussion, glove 10 has a structure that includes various stitchless seams. For example, seam 20 is joined in a stitchless manner, and material elements 32 are joined to material element 31 in a stitchless manner. That is, various elements of glove 10 are joined without stitching. In comparison with a conventional glove, the stitchless seams of glove 10 may enhance the comfort and tactile properties of glove 10. When a polymer adhesive element is utilized to join textile elements, for example, a further benefit is that the polymer adhesive element prevents fraying and unraveling of edges of the textile elements.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. A glove for covering at least a portion of a hand, the glove comprising:

a first material element defining a first edge;

a second material element defining a second edge, the second material element being separate from the first mal element; and at least one thermoplastic polymer adhesive element bonded to each of the first material element and the second material element to join the first material element and the second material element in a stitchless configuration, the first edge being positioned to contact the second edge to form an abutting and non-overlapping interface between the first material element and the second material element, each of the first material element, the second material element, and the at least one thermoplastic polymer adhesive element being two-dimensional materials.

2. The glove recited in claim 1, wherein a portion of the first material element that is adjacent the first edge is coplanar with a portion of the second material element that is adjacent the second edge.

3. The glove recited in claim 1, wherein the at least one thermoplastic polymer adhesive element extends over the abutting image.

4. The glove recited in claim 1, wherein a third material element is secured to the first material element and the second material element with the at least one thermoplastic polymer adhesive element to form the stitchless configuration.

5. The glove recited in claim 1, wherein the at least one thermoplastic polymer adhesive element is positioned between the third material element and each of the first material element and the second material element.

6. The glove recited in claim 5, wherein at least one aperture is defined through the first material element and the at least one thermoplastic polymer adhesive element, and the third material element is exposed through the at least none aperture.

7. The glove recited in claim 5, wherein a first aperture is defined through the first material element and the at least one thermoplastic polymer adhesive element, and a second aperture is defined through the second material element and the at least one thermoplastic polymer adhesive element, the third material element being exposed through each of the first aperture and the second aperture.

8. A glove for covering at least a portion of a hand, the glove comprising:

a first material element having a first edge;

a second material element having a second edge, the second material element being separate from the first material element, the first edge being positioned adjacent the second edge to form an abutting and non-overlapping interface between the first material element and the second material element;

at least one thermoplastic polymer adhesive element extending over the abutting interface, the at least one plastic polymer adhesive element being bonded to the first material element adjacent the first edge and bonded to the send material element adjacent the second edge; and a third material element bonded to the at least one thermoplastic polymer adhesive element and extending over the abutting interface, the at least one thermoplastic polymer adhesive element and the third material element forming a stitchless seam for joining the first material element and the second material element, and each of the first material element, the second material element, the third material element, and the at least one thermoplastic polymer adhesive element being two-dimensional materials.

9. The glove recited in claim 8, wherein at least one aperture is defined though the first material element and the at least one thermoplastic polymer adhesive element, and the third material element is exposed through the at least one aperture.

10. The glove recited in claim 9, wherein the third material element is a mesh material.

11. A glove for covering at least a portion of a hand, the glove comprising:

a first material element forming at least a portion of a palmar region of the glove;

a second material element separate from the first material element and overlapping the first material element to form a first area in the palmar region where the first material element is exposed and a second area in the palmar region where the second material element is exposed; and a thermoplastic polymer adhesive element extending between the first material element and the second material element, the thermoplastic polymer adhesive element being bonded to the first material element and the second material element to join the first material element and the second material element in a stitchless configuration, each of the first material element, the second material element, and the at least one thermoplastic polymer adhesive element being two-dimensional materials, and only the second material element including a silicone coating.

12. The glove recited in claim 11, wherein at least one of the first material element and the second material element is positioned in a digital region of the glove.

13. The glove recited in claim 11, wherein at least one of the first material element and the second material element is positioned in a palmar region of the glove.

14. A method of manufacturing a glove for covering at least a portion of a hand, the method comprising steps of:

positioning a first material element in an about and non-overlapping relationship with a second material element by placing an edge of the first material element in contact with an edge of the second material element, the first material element and the second material element being two-dimensional materials; and forming a stitchless seam between the first material element and the second material element by bonding the first material element and the second material element together with at least one thermoplastic polymer adhesive element, the at least one thermoplastic polymer adhesive element being a two-dimensional material.

15. The method recited in claim 14, further including a step of bonding a third material element to the at least one thermoplastic polymer adhesive element such that the thermoplastic polymer adhesive element is positioned between third material element and each of the first mail element and the second material element.

16. The method recited in claim 15, further including a step of forming an aperture in at least one of the first material element and the second material element to expose a potion of the third material element.

17. A glove for covering at least a portion of a hand, the glove comprising:

a first material element having a first edge;

a second material element having a second edge, the second material element being separate from the first material element, the first edge being positioned adjacent the second edge to form an abutting interface between the first material element and the second material element;

at least one thermoplastic polymer adhesive element extending over the abutting interface, the at least one thermoplastic polymer adhesive element being bonded to the first material element adjacent the first edge and bonded to the second material element adjacent the second edge; and a third material element bonded to the at least one thermoplastic polymer adhesive element and extending over the abutting interface, the at least one thermoplastic polymer adhesive element and the third material element forming a stitchless seam for joining the first material element and the second material element, and each of the first material element, the second material element, the third material element, and the at least one thermoplastic polymer adhesive element being two-dimensional materials, and the at least one thermoplastic polymer adhesive element being a pair of adhesive elements, one of the pair of adhesive elements having a shape that corresponds with a shape of the third material element.

18. A glove for covering at least a portion of a hand, the glove comprising;

a first material element having a first edge;

a second material element having a second edge, the second material element being separate from the first material element, the first edge being positioned adjacent the second edge to form an abutting interface between the first material element and the second material element;

at least one thermoplastic polymer adhesive element extending over the abutting interface, the at least one thermoplastic polymer adhesive element being bonded to the first material element adjacent the first edge and bonded to the second material element adjacent the second edge; and a third material element bonded to the at least one thermoplastic polymer adhesive element and extending over the abutting interface, the at least one thermoplastic polymer adhesive element and the third material element forming a stitchless seam for joining the first material element and the second material element, and each of the first material element, the second material element, the third material element, and the at least one thermoplastic polymer adhesive element being two-dimensional materials, and a first aperture being defined through the first material element and the at least one thermoplastic polymer adhesive element, and a second aperture being defined through the second material element and the at least one thermoplastic polymer adhesive element, the third material element being exposed through each of the first aperture and the second aperture.

* * * * *